US005815066A

United States Patent [19]

Pumilia

[11] Patent Number: 5,815,066

[45] Date of Patent: Sep. 29, 1998

[54] FIRE ALARM SAFETY SILENCING SYSTEM

[76] Inventor: Thomas F. Pumilia, 305 Hurley Ave. #25B, Kingston, N.Y. 12401

[21] Appl. No.: 846,529

[22] Filed: Apr. 29, 1997

[51] Int. Cl.[6] ..... G08B 1/00

[52] U.S. Cl. ..... 340/309.15; 340/514; 340/515; 340/628

[58] Field of Search ..... 340/309.15, 309.3, 340/628, 514, 623, 515, 500

[56] References Cited

U.S. PATENT DOCUMENTS

| | | | |
|---|---|---|---|
| 3,840,871 | 10/1974 | Eguchi et al. | 340/504 |
| 4,032,909 | 6/1977 | Boyce | 340/514 |
| 4,464,651 | 8/1984 | Duhame | 340/521 |
| 4,901,056 | 2/1990 | Bellavia et al. | 340/514 |
| 5,053,751 | 10/1991 | Gould | 340/623 |
| 5,432,500 | 7/1995 | Scripps | 340/628 |
| 5,592,032 | 1/1997 | Keizer et al. | 307/116 |

*Primary Examiner*—Jeffery A. Hofsass
*Assistant Examiner*—Davetta Woods

[57] ABSTRACT

A new Fire Alarm Safety Silencing System for providing a fire alarm which allows a user to silence during false alarms for a finite period of time wherein the fire alarm rearms itself. The inventive device includes a fire alarm having a receiver a transmitter for transmitting a signal to the receiver of the fire alarm for deactivating the fire alarm for a finite period of time during a false alarm, and a length of Velcro and a length of magnet secured to the transmitter for conveniently attaching to a metal surface.

10 Claims, 2 Drawing Sheets

FIRE ALARM SAFETY SILENCING SYSTEM

BACKGROUND OF THE INVENTION

1. Field of the Invention

The present invention relates to Fire Detecting Devices and more particularly pertains to a new Fire Alarm Safety Silencing System for providing a fire alarm which allows a user to silence during false alarms for a finite period of time wherein the fire alarm rearms itself.

2. Description of the Prior Art

The use of Fire Detecting Devices is known in the prior art. More specifically, Fire Detecting Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Fire Detecting Devices include U.S. Pat. No. 4,600,314; U.S. Pat. No. 4,567,477; U.S. Pat. No. 5,186,653; U.S. Pat. No. 4,679,037; U.S. Pat. No. 4,788,530; and U.S. Pat. No. 4,313,110.

While these devices fulfill their respective, particular objectives and requirements, the aforementioned patents do not disclose a new Fire Alarm Safety Silencing System. The inventive device includes a fire alarm having a receiver a transmitter for transmitting a signal to the receiver of the fire alarm for deactivating the fire alarm for a finite period of time during a false alarm, and a length of Velcro and a length of magnet secured to the transmitter for conveniently attaching to a metal surface.

In these respects, the Fire Alarm Safety Silencing System according to the present invention substantially departs from the conventional concepts and designs of the prior art, and in so doing provides an apparatus primarily developed for the purpose of providing a fire alarm which allows a user to silence during false alarms for a finite period of time wherein the fire alarm rearms itself.

SUMMARY OF THE INVENTION

In view of the foregoing disadvantages inherent in the known types of Fire Detecting Devices now present in the prior art, the present invention provides a new Fire Alarm Safety Silencing System construction wherein the same can be utilized for providing a fire alarm which allows a user to silence during false alarms for a finite period of time wherein the fire alarm rearms itself.

The general purpose of the present invention, which will be described subsequently in greater detail, is to provide a new Fire Alarm Safety Silencing System apparatus and method which has many of the advantages of the Fire Detecting Devices mentioned heretofore and many novel features that result in a new Fire Alarm Safety Silencing System which is not anticipated, rendered obvious, suggested, or even implied by any of the prior art Fire Detecting Devices, either alone or in any combination thereof.

To attain this, the present invention generally comprises a fire alarm having a receiver a transmitter for transmitting a signal to the receiver of the fire alarm for deactivating the fire alarm for a finite period of time during a false alarm, and a length of Velcro and a length of magnet secured to the transmitter for conveniently attaching to a metal surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new Fire Alarm Safety Silencing System apparatus and method which has many of the advantages of the Fire Detecting Devices mentioned heretofore and many novel features that result in a new Fire Alarm Safety Silencing System which is not anticipated, rendered obvious, suggested, or even implied by any of the prior art Fire Detecting Devices, either alone or in any combination thereof It is another object of the present invention to provide a new Fire Alarm Safety Silencing System which may be easily and efficiently manufactured and marketed.

It is a further object of the present invention to provide a new Fire Alarm Safety Silencing System which is of a durable and reliable construction.

An even further object of the present invention is to provide a new Fire Alarm Safety Silencing System which is susceptible of a low cost of manufacture with regard to both materials and labor, and which accordingly is then susceptible of low prices of sale to the consuming public, thereby making such Fire Alarm Safety Silencing System economically available to the buying public.

Still yet another object of the present invention is to provide a new Fire Alarm Safety Silencing System which provides in the apparatuses and methods of the prior art some of the advantages thereof, while simultaneously overcoming some of the disadvantages normally associated therewith.

Still another object of the present invention is to provide a new Fire Alarm Safety Silencing System for providing a fire alarm which allows a user to silence during false alarms for a finite period of time wherein the fire alarm rearms itself.

Yet another object of the present invention is to provide a new Fire Alarm Safety Silencing System which includes a fire alarm having a receiver a transmitter for transmitting a signal to the receiver of the fire alarm for deactivating the fire alarm for a finite period of time during a false alarm, and a length of Velcro and a length of magnet secured to the transmitter for conveniently attaching to a metal surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
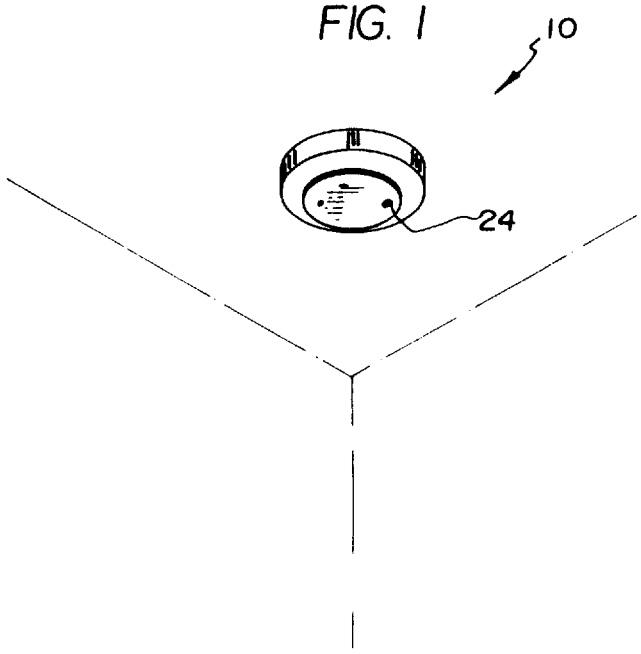
FIG. 1 is a lower perspective view of the fire alarm.

With reference now to the drawings, and in particular to FIGS. 1 through 4 thereof, a new Fire Alarm Safety Silencing System embodying the principles and concepts of the present invention and generally designated by the reference numeral 10 will be described.

As best illustrated in FIGS. 1 through 6, the Fire Alarm Safety Silencing System 10 comprises a fire alarm 20 having a receiver 22 within which detects a signal, and a transmitter 30 which transmits a signal to the receiver 22 within the fire alarm 20 which carries a deactivation code which deactivates the fire alarm 20 for the finite period of time and upon expiration of the finite period of time the fire alarm 20 reactivates itself The finite period of time preferably is for at least ten minutes which allows a cause of a false alarm to be eliminated. The fire alarm 20 includes an LED 24 which emits light when the fire alarm 20 is deactivated during the finite period of time as shown in FIG. 1 of the drawings.

Figure 3:
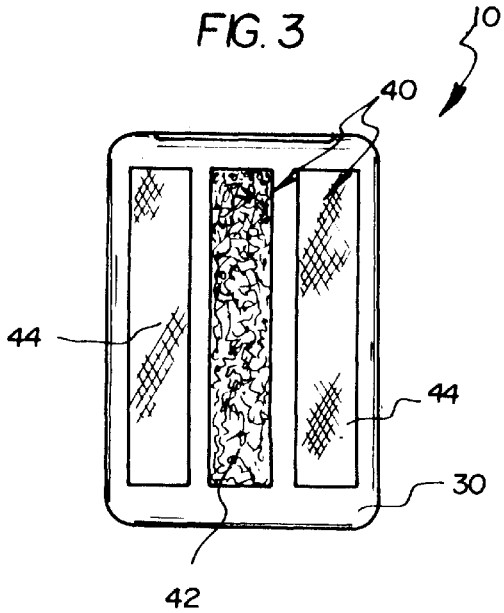
FIG. 3 is a rear view of the transmitter disclosing the securing means.
Figure 4:
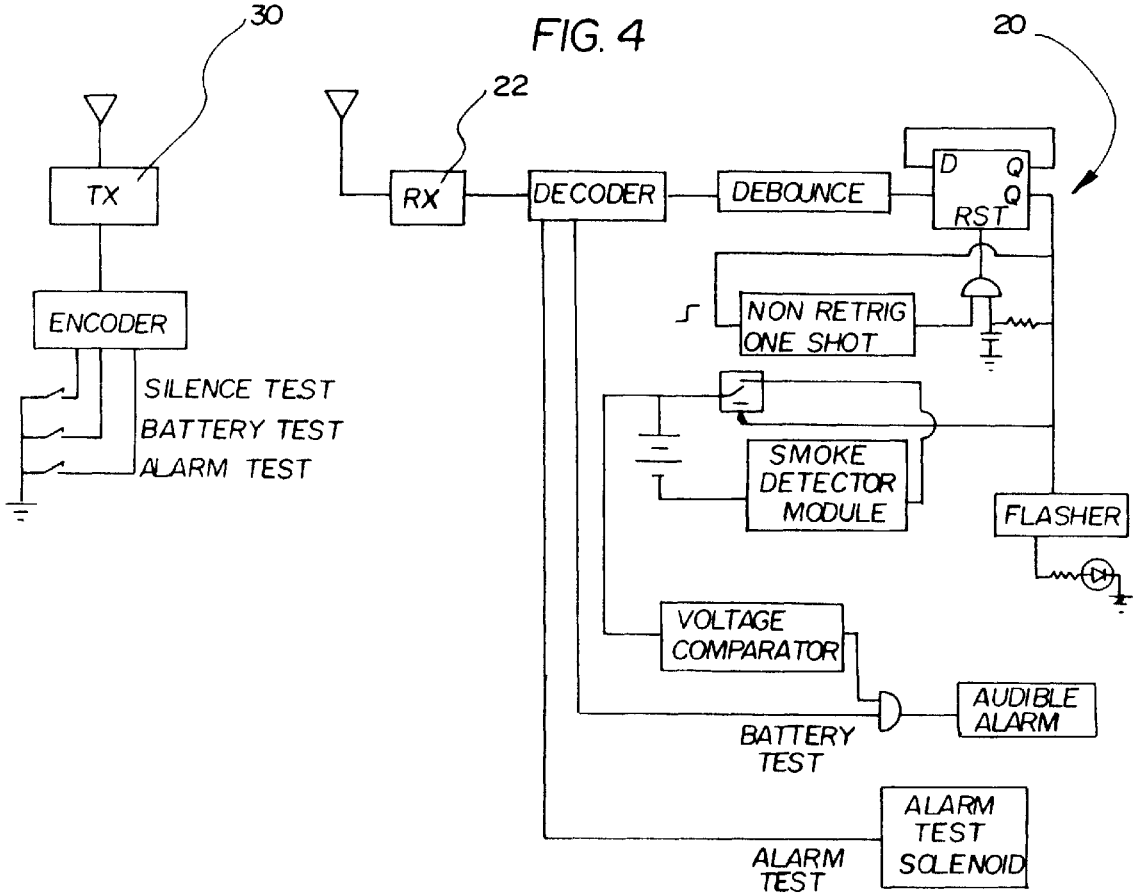
FIG. 4 is a schematic illustration of the present invention.

As shown in FIG. 3 of the drawings, a securing means 40 is attached to a rear surface of the transmitter 30 for removably securing the transmitter 30 to a convenient storage surface. The securing means 40 preferably comprises a length of Velcro 42 and a length of magnet 44 for attaching to the convenient storage surface.

Figure 2:
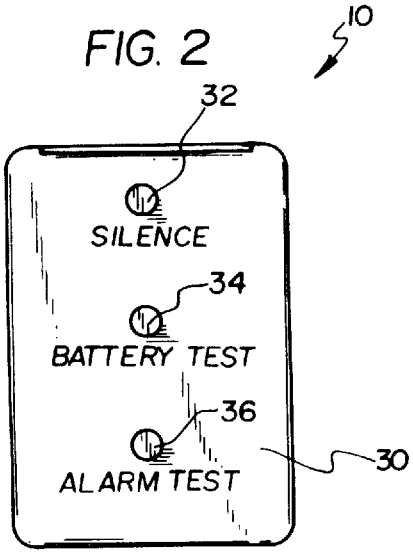
FIG. 2 is a front view of the transmitter.

As shown in FIG. 2 of the drawings, the transmitter 30 has a first switch 32 whereupon being depressed the transmitter 30 transmits the signal carrying the deactivation code which is detected by the receiver 22 of the fire alarm 20. The transmitter 30 has a second switch 34 whereupon being depressed the transmitter 30 transmits the signal carrying a battery test code which is detected by the receiver 22 of the fire alarm 20 and the fire alarm 20 emits an audible sound if a battery within the fire alarm 20 is charged sufficiently. The transmitter 30 has a third switch 36 whereupon being depressed the transmitter 30 transmits the signal carrying battery test code which is detected by the receiver 22 of the fire alarm 20 and the fire alarm 20 emits an audible sound if the fire alarm 20 is activated properly.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fire alarm system which allows a user to remotely deactivate said fire alarm system for a finite period of time whereafter the fire alarm system reactivates itself, comprising:

a fire alarm having a receiver within which detects a signal;

a transmitter which transmits said signal to said receiver within said fire alarm which carries a deactivation code which deactivates said fire alarm for said finite period of time and upon expiration of said finite period of time said fire alarm reactivates itself;

said transmitter comprising a first switch whereupon being depressed said transmitter transmits said signal carrying said deactivation code;

a second switch whereupon being depressed said transmitter transmits said signal carrying a battery test code;

a third switch whereupon being depressed said transmitter transmits said signal carrying said battery test code; and an LED which emits light when said fire alarm is selectively deactivated during said finite period of time.

2. The fire alarm system of claim 1, including a securing means attached to a rear surface of said transmitter for removably securing said transmitter to a convenient storage surface.

3. The fire alarm system of claim 1, wherein said fire alarm includes an LED which emits light when said fire alarm is deactivated during said finite period of time comprises at least ten minutes.

4. The fire alarm system of claim 1, wherein said deactivation code is detected by said receiver of said fire alarm.

5. The fire alarm system of claim 1, wherein whereupon said second switch is depressed and said transmitter transmits said signal carrying said battery test code which is detected by said receiver of said fire alarm, said fire alarm emits an audible sound if a battery within said fire alarm is charged sufficiently.

6. The fire alarm system of claim 1, wherein whereupon said third switch is depressed and said transmitter transmits said signal carrying said battery test code which is detected by said receiver of said fire alarm, said fire alarm emits an audible sound if said fire alarm is activated properly.

7. The fire alarm system of claim 1, wherein said finite period of time allows the alarm to be deactivated once the cause of a false alarm is eliminated.

8. The fire alarm system of claim 2, wherein said securing means comprises a length of hook and loop fastener for attaching to said convenient storage surface.

9. The fire alarm system of claim 2, wherein said securing means comprises a length of magnet for removably securing to magnetic surfaces.

10. The fire alarm system of claim 2, wherein said securing means comprises a length of hook and loop fastener and a length of magnet for removably attaching to said convenient storage surface.

* * * * *